United States Patent [19]

Slavsky

[11] 3,975,847

[45] Aug. 24, 1976

[54] ONE-PIECE CLIP

[75] Inventor: Robert J. Slavsky, Southfield, Mich.

[73] Assignee: Shaw & Slavsky, Inc., Detroit, Mich.

[22] Filed: Nov. 24, 1975

[21] Appl. No.: 634,780

[52] U.S. Cl. ..... 40/11 R

[51] Int. Cl.[2] ..... G09F 3/18

[58] Field of Search ..... 40/11 R, 11 A, 10 R, 40/10 C, 128, 124.1, 16.2, 16, 16.4, 16.6; 24/213 B

[56] References Cited

UNITED STATES PATENTS

| | | | |
|---|---|---|---|
| 2,698,472 | 1/1955 | Knohl | 24/213 B |
| 2,761,230 | 9/1956 | Finnegan | 40/11 R |
| 3,205,546 | 9/1965 | Nelson | 24/213 B |
| 3,324,585 | 6/1967 | Frederickson | 40/11 R |
| 3,728,806 | 4/1973 | Kostiuk | 40/11 R |
| 3,797,143 | 3/1974 | Miller | 40/10 R |

*Primary Examiner*—John F. Pitrelli

*Attorney, Agent, or Firm*—Cullen, Settle, Sloman & Cantor

[57] ABSTRACT

A novel one-piece clip of springy, somewhat stiff sheet metal for mounting a card in a shelf molding, the parts being so formed as to facilitate mounting and dismounting of the clip with respect to the molding.

1 Claim, 4 Drawing Figures

ONE-PIECE CLIP

GENERAL DISCUSSION

On the market at the present time is a two-piece clip produced under the name of "Point of Sales" and exemplified by the patent to Frederickson U.S. Pat. No 3,324,585.

The present invention provides an improved form of clip, improved in that it is of one piece of metal instead of two pieces riveted to each other, thereby reducing the cost of manufacture, the weight, the fragility, etc. of the clip but also the present clip is so formed that it is considerably easier to mount and dismount with respect to a shelf molding.

SEARCH

A variety of clips have been found on a preliminary search and except for the clips in the patent to Miller, U.S. Pat. No. 3,797,143 there seems to be no need to discuss the clips shown in the patents found on such search, but such patents are here listed:

| | |
|---|---|
| Guyer | 3,084,463; |
| Finnegan | 2,761,230; |
| Knohl | 2,698,472; |
| Egan | 1,719,505; |
| Hopp | 1,417,325; |
| Hembd | 3,051,177; |
| Kostiuk | 3,728,806; |
| Gutterson | 3,530,605; |

The present clip is an improvement over and differs from that of the clip of Miller U.S. Pat. No. 3,797,143 and the differences will become apparent upon a reading of the specification which follows and upon reference to the appended drawing. In such drawing, FIG. 1 is a front view of the clip per se;

FIG. 2 is a side view as if on arrow 2 of FIG. 1 showing the clip in place in a shelf molding;

FIGS. 3 and 4 are section views as if on lines 3—3 and 4—4 of FIG. 1.

DETAILED DESCRIPTION

Figure 2:
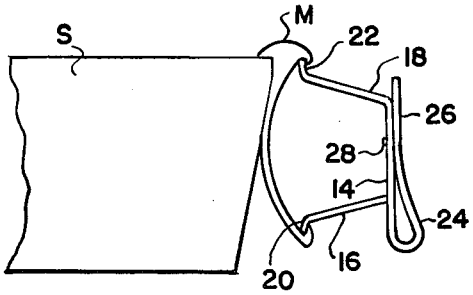
Figure 1:
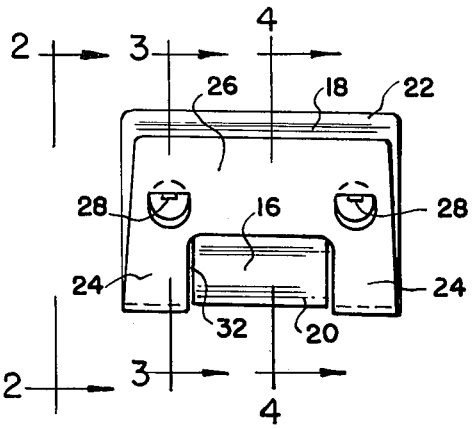
Figure 3:
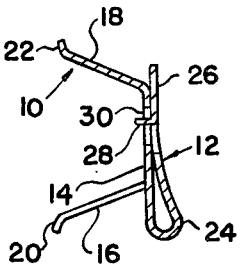
Figure 4:
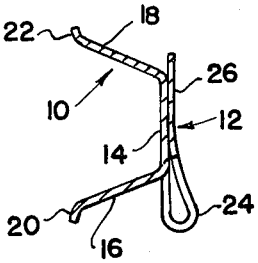

The drawing shows a one-piece clip of springy, but somewhat stiff sheet metal, such as spring steel, having a first or mounting portion 10 and a second or card receiving portion 12.

Portion 10 comprises a wide central vertical part 14 and two rearwardly extending diverging parts 16–18, these having narrow free edge lips 20–22.

Portion 12 comprises said part 14, two laterally spaced U-shaped loops or parts 24 below and between which is part 14. Portion 12 also includes an upper front part 26 which has rearwardly extending card piercing lances 28 projected through holes 30 in part 14 and in vertical alignment with the U-shaped parts 24.

Part 26 has its upper edge free, and well above, the upper edge of part 14, and well above part 18.

Part 16 is well below the lower edge of part 26 to be exposed and accessible from the front through the space 32 between parts 24.

USE

The clip may easily be mounted in a molding M. FIG. 2, on the front edge of a shelf S by placing a lip 20 or 22 in a groove of the molding and squeezing parts 16 and 18 together with the thumb and a finger, with the thumb fitting into space 32 between loops 34. The other lip may thus be inserted in the molding.

The clip may easily be removed from the molding also be squeezing parts 16 and 18 together, with the thumb and a finger, with the thumb fitting into space 32 between loops 24.

Since the upper edge of front part 26 is above part 18, and since the part 16 is exposed to the front through space 32, the clip is easy to mount and dismount.

Now having described the clip shown in the drawing, I claim:

1. In a one-piece card clip, for use with a shelf molding, formed of springy, somewhat stiff, sheet metal having:

a first, mounting portion, and a second, card receiving portion; with the first, mounting portion comprising a wide, central vertical part, and two rearwardly extending diverging parts having narrow free edge lips; with the lower one of said two rearwardly extending parts being narrower than the central vertical part; the improvement comprising the second, card receiving portion including said central vertical part, a lower front part comprising two laterally spaced U-shaped loop parts behind and between which is the central vertical part, an upper front part overlapping a major portion of said central vertical part, and comprising a member joining said U-shaped loop parts and forming therewith a total front part of inverted U-shape, said upper front part having rearwardly extending lances projected through holes of said central vertical part but in vertical alignment with the U-shaped loop parts;

the upper edge of the upper front part being free and well above the upper edge of the central vertical part and well above the upper rearwardly extending diverging part whereby said upper edge may be easily grasped so as to disengage said front part from said central vertical part;

and the lower edge of the upper front part being substantially above the lower rearwardly extending diverging part thereby forming said inverted U-shaped front part so that said lower diverging part is exposed to and is accessible from the front through the space between the two U-shaped loop parts.

* * * * *